US011434591B2

(12) United States Patent
Schauer et al.

(10) Patent No.: US 11,434,591 B2
(45) Date of Patent: Sep. 6, 2022

(54) HIERARCHICALLY STRUCTURED CARBON NANOTUBE ARTICLES AND METHODS FOR PRODUCTION THEREOF

(71) Applicant: Nanocomp Technologies, Inc., The Woodlands, TX (US)

(72) Inventors: Mark W. Schauer, Dublin, NH (US); Erick C. Towle, Concord, NH (US)

(73) Assignee: Nanocomp Technologies, Inc., The Woodlands, TX (US)

( * ) Notice: Subject to any disclaimer, the term of this patent is extended or adjusted under 35 U.S.C. 154(b) by 47 days.

(21) Appl. No.: 16/572,655

(22) Filed: Sep. 17, 2019

(65) Prior Publication Data

US 2020/0010988 A1 Jan. 9, 2020

Related U.S. Application Data

(62) Division of application No. 14/952,427, filed on Nov. 25, 2015, now Pat. No. 10,465,317.

(60) Provisional application No. 62/084,625, filed on Nov. 26, 2014.

(51) Int. Cl.

| | |
|---|---|
| ***D04H 13/00*** | (2006.01) |
| ***D04H 1/70*** | (2012.01) |
| ***D04H 1/559*** | (2012.01) |
| ***D04H 1/72*** | (2012.01) |
| ***D04H 1/4242*** | (2012.01) |
| ***D04H 1/4374*** | (2012.01) |

(52) U.S. Cl.

CPC ..... *D04H 1/559* (2013.01); *D04H 1/4242* (2013.01); *D04H 1/4374* (2013.01); *D04H 1/72* (2013.01)

(58) Field of Classification Search

None

See application file for complete search history.

(56) References Cited

U.S. PATENT DOCUMENTS

| | | | | |
|---|---|---|---|---|
| 7,993,620 | B2 * | 8/2011 | Lashmore | D02G 3/02 423/447.1 |
| 2002/0127162 | A1 * | 9/2002 | Smalley | H01G 9/2059 524/495 |
| 2007/0122687 | A1 * | 5/2007 | Sakurai | B01D 39/2072 442/59 |

(Continued)

*Primary Examiner* — Shawn Mckinnon

(74) *Attorney, Agent, or Firm* — Nanocomp Technologies, Inc.; Robert Diaz

(57) ABSTRACT

The present invention provides, in one embodiment, a nanostructured article. In an embodiment, the nanostructured article includes a first material made from a plurality of intermingled nanotubes placed on top of one another to form a continuous structure with sufficient structural integrity to be handled. The nanostructured article can also include a second material made from a plurality of nanotubes forming a layer situated on a surface of the first material. The second material, in an embodiment, has a nanotube density lower than the nanotube density of the first material. The nanostructured article further a layer of ordered pyrolytic carbon between the first material and the second material to enhance the bond and structural integrity between the first material and the second material, as well as enhancing the electrical and thermal conductivity between the first and second materials. A process for forming the nanostructured article is also provided.

9 Claims, 10 Drawing Sheets

(56) References Cited

U.S. PATENT DOCUMENTS

| | | | | |
|---|---|---|---|---|
| 2009/0214816 | A1* | 8/2009 | Hata | B82Y 30/00 428/114 |
| 2010/0272978 | A1* | 10/2010 | Kumar | H01B 1/24 428/220 |
| 2013/0189565 | A1* | 7/2013 | Lashmore | H01M 10/04 429/163 |

* cited by examiner

HIERARCHICALLY STRUCTURED CARBON NANOTUBE ARTICLES AND METHODS FOR PRODUCTION THEREOF

CROSS REFERENCE TO RELATED APPLICATION

The present application is a divisional application of U.S. patent application Ser. No. 14/952,427 filed Nov. 25, 2015, which claims priority to U.S. Provisional Patent Application No. 62/084,625 filed Nov. 26, 2014, each of which is incorporated herein by reference in its entirety.

TECHNICAL FIELD

The present disclosure relates generally to nanostructured articles, and in particular, an article including a first, high-density nanotube-containing material having high strength, and high electrical and thermal conductivity, and a second, lower-density nanotube-containing material having high surface area and high porosity.

BACKGROUND

Due to their high electrical and thermal conductivity, CNT materials are being used in a wide variety of electrical applications, including batteries, capacitors, catalytic membranes, and cables. Electrochemical functionality and chemical catalysis in such applications may benefit from materials having high surface area and porosity. These properties are typically associated with low density materials. On the other hand, other beneficial properties such as good electrical and/or thermal conductivity are typically associated with higher density materials. Accordingly, it can be difficult to obtain each of these beneficial properties in the same material or article.

SUMMARY

The present invention provides, in one embodiment, a method for forming a nanostructured article. The method includes generating, from a cloud of nanotubes synthesized in a reactor, a high-density non-woven material. In one embodiment, the high-density non-woven material can be a sheet or yarn, and is provided with a nanotube density ranging from a about 0.75 g/cc to about 1.5 g/cc. The process of generating the high-density non-woven material, in an embodiment, provides a layer of ordered pyrolytic carbon on the high-density non-woven material.

Once the high-density non-woven material is generated, a plurality of nanotubes is deposited on a surface of the high-density non-woven material to form a low-density layer of nanotubes on the high-density non-woven material. In an embodiment, the low-density layer has a nanotube density ranging from about 0.1 g/cc to about 0.5 g/cc, and pores ranging from about 0.1 micron to about 10 microns. Thereafter, the low-density layer of nanotubes deposited on the high-density non-woven is allowed bond with the surface of the high-density non-woven material in the presence of the ordered pyrolitic layer to form the resulting nanostructured article.

The present invention further provides, in an embodiment, a nanostructured article. In an embodiment, the nanostructured article includes a first material made from a plurality of intermingled nanotubes placed on top of one another to form a continuous structure with sufficient structural integrity to be handled. In one embodiment, the first material can be a sheet or yarn, and is provided with a nanotube density ranging from a about 0.75 g/cc to about 1.5 g/cc. The first material may also have an electrical conductivity of ranging from about 1 S/m to about 10E6 S/m. The nanostructured article can also include a second material made from a plurality of nanotubes forming a layer situated on a surface of the first material. The second material, in an embodiment, has a nanotube density lower than the nanotube density of the first material. In an embodiment, the second material has a nanotube density ranging from about 0.1 g/cc to about 0.5 g/cc, and pores ranging from about 0.1 micron to about 10 microns. The nanostructured article further a layer of ordered pyrolytic carbon between the first material and the second material to enhance the bond and structural integrity between the first material and the second material, as well as enhancing the electrical and thermal conductivity between the first and second materials.

DETAILED DESCRIPTION

The present disclosure will now be described more fully hereinafter. Subject matter may be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended.

High Density CNT Material I and Low Density CNT Material 2

Figure 1:
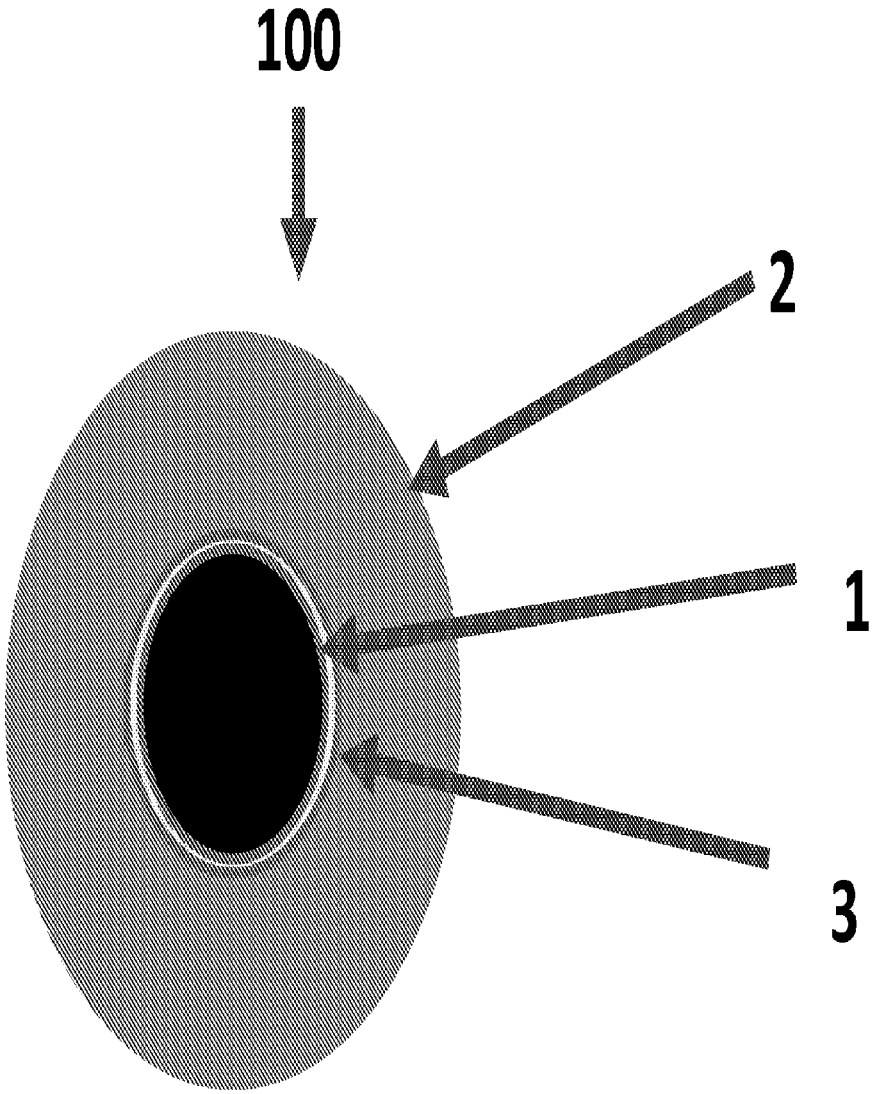
FIG. 1 depicts a cross-sectional schematic view of a hierarchically structured yarn material according to an embodiment of the present disclosure.
Figure 2:
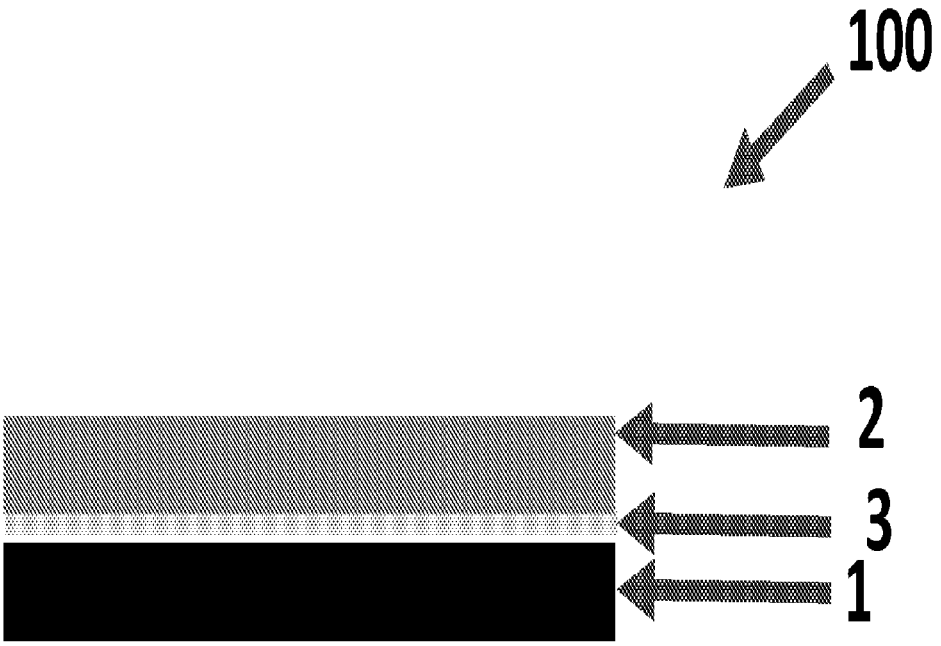
FIG. 2 depicts a cross-sectional schematic view of a hierarchically structured sheet material according to an embodiment of the present disclosure.

Referring now to FIGS. 1 and 2, a nanostructured article 100 is provided having a first material 1 with high nanotube density (HD-CNT material 1), and a second material 2 with low nanotube density (LD-CNT material 2).

HD-CNT material 1 may be characterized, at least in part due to its high nanotube density, as having high electrical and/or thermal conductivity, as well as high tensile strength. LD-CNT material 2 may be characterized, at least in part due to its relatively lower nanotube density, as having high porosity.

LD-CNT material 2, in various embodiments, may be situated on a surface of HD-CNT material 1. The nanostructured article 100, in one embodiment, may be elongated (not shown) and may take the form of a yarn, cable, or other similar elongate article. HD-CNT material 1 may form a core of the elongated article, and LD-CNT material 2 may form a sheath or other layer on at least a portion of an outer surface of HD-CNT core material 1. In this way, the nanostructured article 100 comprises two or more hierarchically structured layers formed of materials 1 and 2 with the properties of both high density and low density CNT materials.

Alternatively, as shown in FIG. 2, the nanostructured article 100 may be substantially planar and may take the form of a sheet, ribbon, tape, or other similar planar article. In the planar embodiment, LD-CNT material 2 may be situated on a surface of HD-CNT material 1, such that the nanostructured article 100 comprises two or more hierarchically structured layers formed of materials 1 and 2 with the properties of both high density and low density CNT materials.

In accordance with one embodiment of the present invention, between the HD-CNT material 1 and LD-CNT material 2 of the nanostructured article 100, there may be a layer of ordered pyrolytic carbon (OPC) 3 provided to enhance the structural and mechanical integrity between the HD-CNT material 1 and the LD-CNT material 2. The presence of the OPC layer 3 can also enhance electrical and thermal conductivity between materials 1 and 2, and thus throughout the nanostructured article 100.

Nanotubes for use in connection with the present disclosure may be fabricated using a variety of approaches. Presently, there exist multiple processes and variations thereof for growing nanotubes. These include: (1) Chemical Vapor Deposition (CVD), a common process that can occur at near ambient or at high pressures, (2) Arc Discharge, a high temperature process that can give rise to tubes having a high degree of perfection, and (3) Laser ablation. It should be noted that although reference is made below to nanotube synthesized from carbon, other compound(s) may be used in connection with the synthesis of nanotubes for use with the present invention.

The present disclosure, in one embodiment, employs a Chemical Vapor Deposition (CVD) process or similar gas phase pyrolysis procedures to generate the appropriate sheet type materials made from carbon-based nanostructures, including carbon nanotubes. Carbon nanotubes, including single wall (SWNT), double wall (DWNT), and multiwall (MWNT), may be grown, in an embodiment of the present invention, by exposing nanoscaled catalyst particles in the presence of reagent carbon-containing gases (i.e., gaseous carbon source at elevated temperatures). In particular, the nanoscaled catalyst particles may be introduced into the reagent carbon-containing gases, either by addition of existing particles or by in situ synthesis of the particles from a metal-organic precursor, or even non-metallic catalysts. Although SWNT, DWNT, and MWNT may be grown, in certain instances, SWNT may be selected due to their relatively higher growth rate and tendency to form rope-like structures, which may offer advantages in handling, thermal conductivity, electronic properties, and strength.

The strength of the individual nanotubes generated in connection with the present invention may be about 30 GPa or more. Strength, as should be noted, is generally sensitive to defects. However, the elastic modulus of individual carbon nanotubes fabricated in accordance with an embodiment of the present invention may not be sensitive to defects and can vary from about 1 to about 1.2 TPa. Moreover, the strain to failure, which generally can be a structure sensitive parameter, may range from about 10% to about 25% for carbon nanotubes used in the present invention.

Furthermore, the nanotubes of the present invention can be provided with relatively small diameter. In an embodiment of the present invention, the nanotubes fabricated in the present invention can be provided with a diameter in a range of from less than 1 nm to about 10 nm.

In various embodiments, materials made from nanotubes of the present invention can represent a significant advance over copper and other metallic conducting members, as such materials are electrical conductors. In addition, CNT sheets made in accordance with an embodiment of the present invention can be a good insulator in a direction normal (e.g., transverse) to the plane of the CNT sheet, while being a good conductor in the plane of the CNT sheet. Additional anisotropy can be introduced within the plane by stretching the sheets (to substantially the CNTs within the sheet.).

Any of the embodiments herein referencing carbon nanotubes may also be modified within the spirit and scope of the disclosure to substitute other tubular nanostructures, including, for example, inorganic or mineral nanotubes. Inorganic or mineral nanotubes include, for example, silicon nanotubes, boron nitride nanotubes and carbon nanotubes having heteroatom substitution in the nanotube structure.

Systems and Methods for Fabricating High Density CNT Material I

Figure 3:
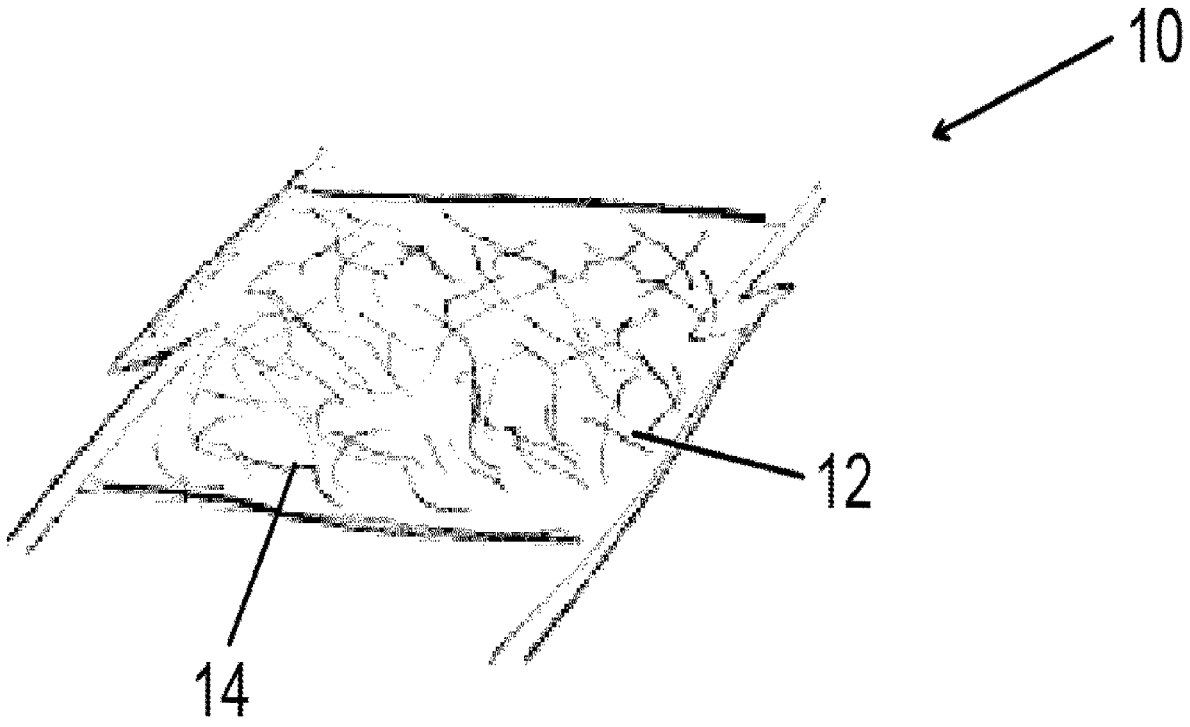
FIG. 3 depicts a schematic view of a high-density CNT sheet material according to an embodiment of the present disclosure.
Figure 4:
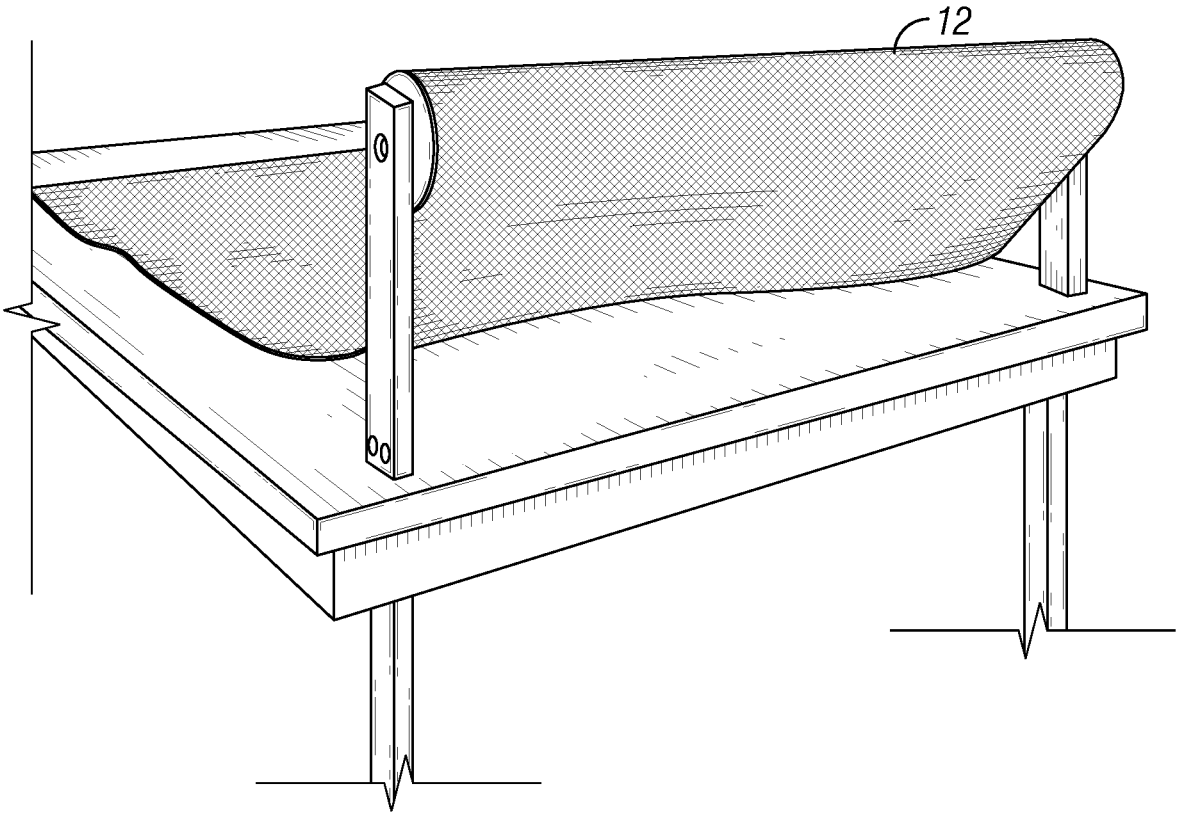
FIG. 4 depicts a roll of a high-density CNT sheet material according to an embodiment of the present disclosure.

Looking now at FIGS. 3 and 4, the present invention provides, in an embodiment, a CNT strip 10 made from a nanostructured CNT sheet 12. The CNT strip 10 can be so designed to allow electrical conductivity along its length, i.e., within the plane of the CNT sheet 12. As shown in FIG. 3, the CNT strip 10 may include a substantially planar body in the form of a single CNT sheet 12. The sheet 12 may, in one embodiment, be a single layer of a plurality of non-woven carbon nanotubes 14 deposited on top of one another from a cloud of CNT, or alternatively be multiple layers 51, where each layer being a plurality of non-woven nanotubes deposited on top of one another from a cloud of CNT (see FIG. 7) to ultimately form the single sheet 12. In case of a multiple-layer layer sheet, the plurality of non-woven carbon nanotubes forms a phyllo-dough structure, whereby each layer includes a plurality of non-woven carbon nanotubes deposited on top of one another from a cloud of CNT. In other embodiments, the CNT strip 10 can be one or more CNT yarns.

Figure 5:
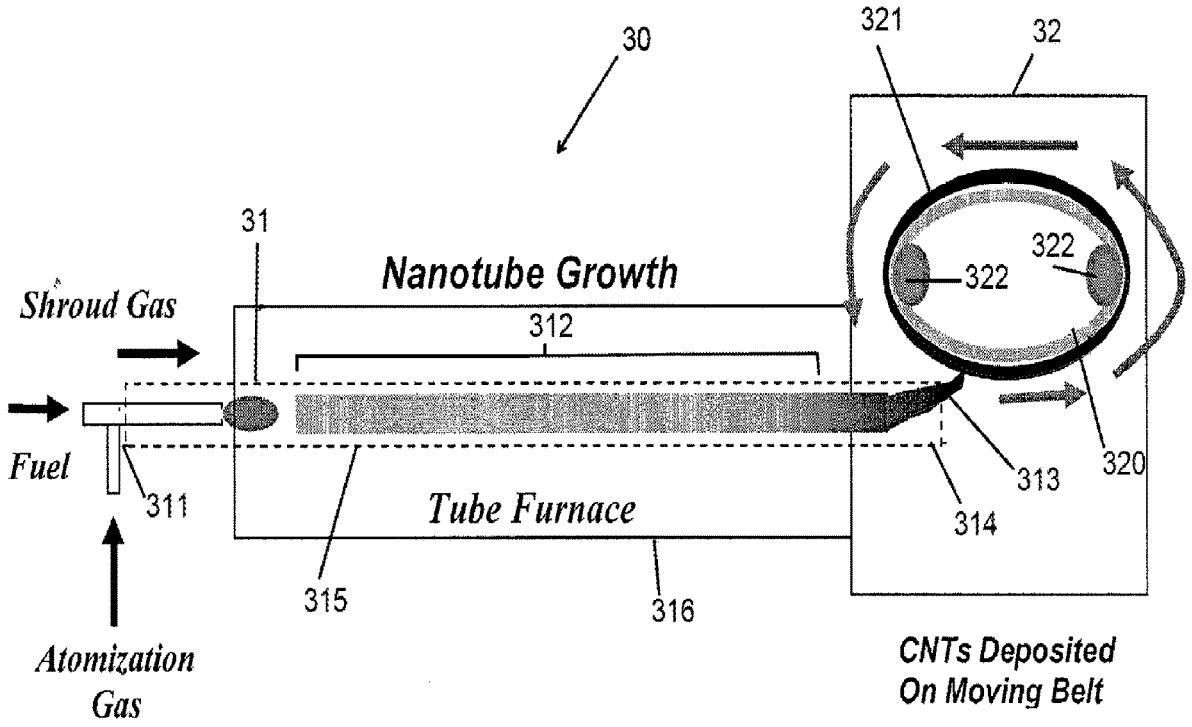
FIG. 5 depicts a system for formation and harvesting of high-density CNT sheet materials according to an embodiment of the present disclosure.

With reference now to FIG. 5, there is illustrated a system 30, similar to that disclosed in U.S. Pat. No. 7,993,620 (filed Jul. 17, 2006; incorporated herein by reference), for use in the fabrication of nanotubes. System 30, in an embodiment, may include a synthesis chamber 31. The synthesis chamber 31, in general, includes an entrance end 311, into which reaction gases (i.e., gaseous carbon source) may be supplied, a hot zone 312, where synthesis of nanotubes 313 may occur, and an exit end 314 from which the products of the reaction, namely a cloud of nanotubes and exhaust gases, may exit and be collected. The synthesis chamber 31, in an embodiment, may include a quartz tube, a ceramic tube or a FeCrAl tube 315 extending through a furnace 316. The nanotubes generated by system 30, in one embodiment, may be individual single-walled nanotubes, bundles of such nanotubes, and/or intermingled or intertwined single-walled nanotubes, all of which may be referred to hereinafter as "non-woven."

System 30, in one embodiment of the present invention, may also include a housing 32 designed to be substantially fluid (e.g., gas, air, etc.) tight, so as to minimize the release of potentially hazardous airborne particulates from within the synthesis chamber 31 into the environment. The housing 32 may also act to prevent oxygen from entering into the system 30 and reaching the synthesis chamber 31. In particular, the presence of oxygen within the synthesis chamber 31 can affect the integrity and can compromise the production of the nanotubes 313.

System 30 may also include a moving belt 320, positioned within housing 32, designed for collecting synthesized nanotubes 313 generated from within synthesis chamber 31 of system 30. In particular, belt 320 may be used to permit nanotubes collected thereon to subsequently form a substantially continuous extensible structure 321, for instance, a CNT sheet. Such a CNT sheet may be generated from substantially non-aligned, non-woven nanotubes 313, with sufficient structural integrity to be handled as a sheet. Belt 320, in an embodiment, can be designed to translate back and forth in a direction substantially perpendicular to the flow of gas from the exit end 314, so as to increase the width of the CNT sheet 321 being collected on belt 320.

To collect the fabricated nanotubes 313, belt 320 may be positioned adjacent the exit end 314 of the synthesis chamber 31 to permit the nanotubes to be deposited on to belt 320. In one embodiment, belt 320 may be positioned substantially parallel to the flow of gas from the exit end 314, as illustrated in FIG. 5. Alternatively, belt 320 may be positioned substantially perpendicular to the flow of gas from the exit end 314 and may be porous in nature to allow the flow of gas carrying the nanomaterials to pass through the belt. In one embodiment, belt 320 can be designed to translate from side to side in a direction substantially perpendicular to the flow of gas from the exit end 314, so as to generate a sheet that is substantially wider than the exit end 314. Belt 320 may also be designed as a continuous loop, similar to a conventional conveyor belt, such that belt 320 can continuously rotate about an axis, whereby multiple substantially distinct layers of CNT can be deposited on belt 320 to form a single sheet 321, such as that shown in FIG. 7. To that end, belt 320, in an embodiment, may be looped about opposing rotating elements 322 and may be driven by a mechanical device, such as an electric motor. In one embodiment, the mechanical device may be controlled through the use of a control system, such as a computer or microprocessor, so that tension and velocity can be optimized. The deposition of multiple layers of CNT in formation of sheet 321, in accordance with one embodiment of the present invention, can result in minimizing interlayer contacts between nanotubes. Specifically, nanotubes in each distinct layer of sheet 321 tend not to extend into an adjacent layer of sheet 321. As a result, normal-to-plane thermal conductivity can be minimized through sheet 321.

It should be appreciated that in connection with the process of fabricating the CNT sheet 321 in accordance with an embodiment of the present invention, a film or layer of ordered pyrolytic carbon is provided or formed on the sheet 321. The ordered pyrolytic carbon film 3 (see FIGS. 3 and 4), in one embodiment, may be generated from carbon atoms that have not fully used in the formation of the individual carbon nanotubes. This layer or film 3 can help to enhance the structurally and mechanical integrity between sheet 321 and a low-density material that may be deposited on top of sheet 321 to subsequently form the nanostructured article. The presence of layer or film 3 can also enhance electrical and thermal conductivity throughout nanostructured article.

To disengage the CNT sheet 321 of intermingled non-woven nanomaterials from belt 320 for subsequent removal from housing 32, a blade (not shown) may be provided adjacent the roller with its edge against surface of belt 320. In this manner, as CNT sheet 321 is rotated on belt 320 past the roller, the blade may act to lift the CNT sheet 321 from surface of belt 320. In an alternate embodiment, a blade does not have to be in use to remove the CNT sheet 321. Rather, removal of the CNT sheet may be by hand or by other known methods in the art.

Additionally, a spool (not shown) may be provided downstream of blade, so that the disengaged CNT sheet 321 may subsequently be directed thereonto and wound about the spool for harvesting. As the CNT sheet 321 is wound about the spool, a plurality of layers of CNT sheet 321 may be formed. Of course, other mechanisms may be used, so long as the CNT sheet 321 can be collected for removal from the housing 32 thereafter. The spool, like belt 320, may be driven, in an embodiment, by a mechanical device, such as an electric motor, so that its axis of rotation may be substantially transverse to the direction of movement of the CNT sheet 321.

In order to minimize bonding of the CNT sheet 321 to itself as it is being wound about the spool; a separation material may be applied onto one side of the CNT sheet 321 prior to the sheet being wound about the spool. The separation material for use in connection with the present invention may be one of various commercially available metal sheets or polymers that can be supplied in a continuous roll. To that end, the separation material may be pulled along with the CNT sheet 321 onto the spool as sheet is being wound about the spool. It should be noted that the polymer comprising the separation material may be provided in a sheet, liquid, or any other form, so long as it can be applied to one side of CNT sheet 321. Moreover, since the intermingled nanotubes within the CNT sheet 321 may contain catalytic nanoparticles of a ferromagnetic material, such as Fe, Co, Ni, etc., the separation material, in one embodiment, may be a non-magnetic material, e.g., conducting or otherwise, so as to prevent the CNT sheet from sticking strongly to the separation material. In an alternate embodiment, a separation material may not be necessary.

After the CNT sheet 321 is generated, it may be left as a CNT sheet or it may be cut into smaller segments, such as strips. In an embodiment, a laser may be used to cut the CNT sheet 321 into strips as the belt 320 or drum rotates and/or simultaneously translates. The laser beam may, in an embodiment, be situated adjacent the housing 32 such that the laser may be directed at the CNT sheet 321 as it exits the housing 32. A computer or program may be employed to control the operation of the laser beam and also the cutting of the strip. In an alternative embodiment, any mechanical means or other means known in the art may be used to cut the CNT sheet 321 into strips.

Figure 6:
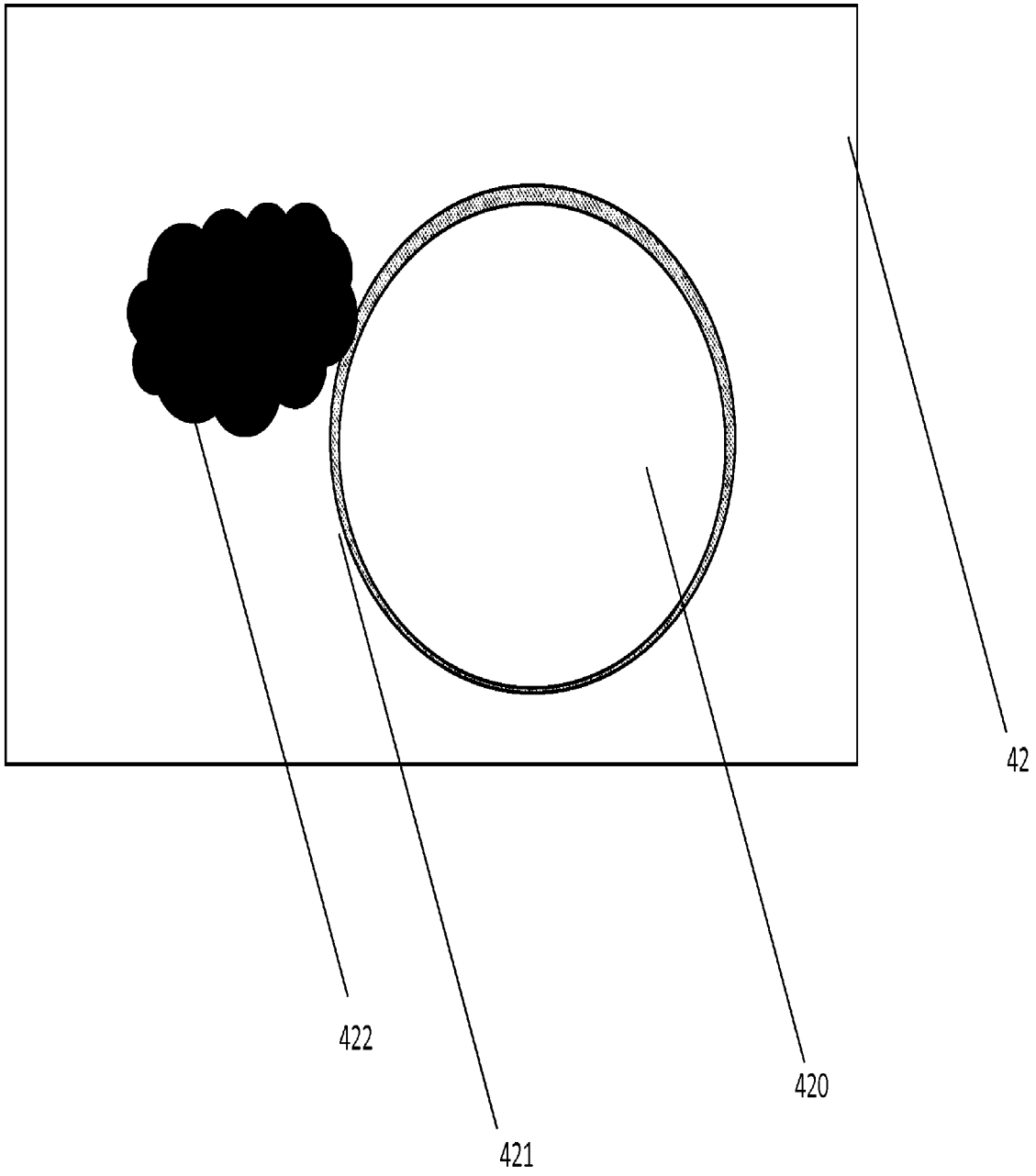
FIG. 6 depicts a cloud of nanotubes being collected on a rotating belt or drum according to an embodiment of the present disclosure.

Alternatively, in another embodiment, instead of a belt, a rigid cylinder such as drum 420 shown in FIG. 6 can be positioned to rotate about an axis, whereby multiple substantially distinct layers of CNT from a cloud of CNT 422 can be deposited on drum 420 to form a sheet 421.

To the extent desired, CNT yarns, sheets or tapes may be further processed to improve or optimize tensile strength and/or electrical conductivity. This post-synthesis processing may include, but is not limited to: cleaning, stretching, exfoliation, densification, cross-linking, or any combination thereof. Processes to accomplish these tasks may include, but are not limited to: thermal, plasma, solvent dip, mechanical, chemical, electrochemical, or any combination thereof. In any case a combination of techniques can used to obtain optimal density, strength and electrical conductivity for the core/support material 1 for the hierarchical structure in the desired form factor.

Figure 8:
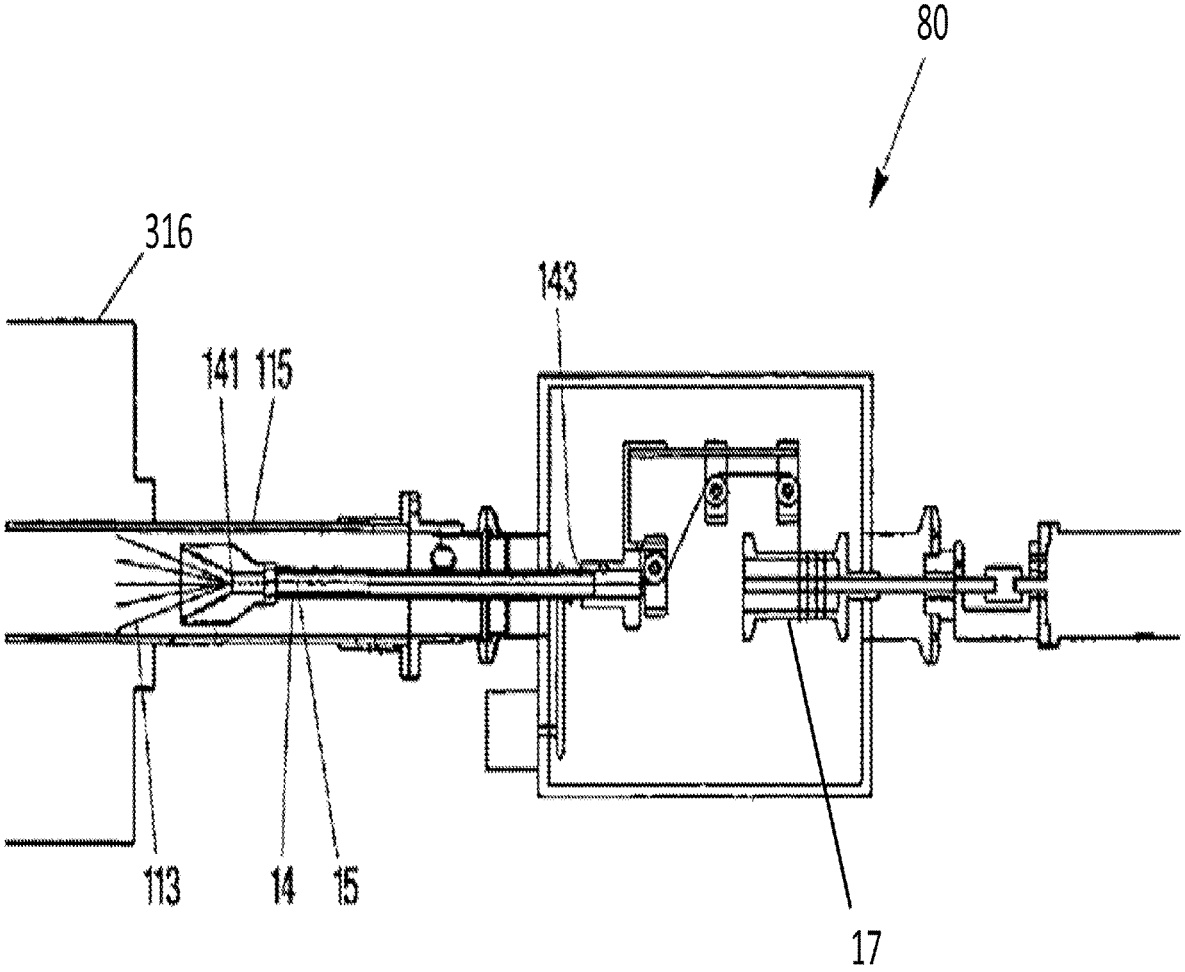
FIG. 8 depicts a system for formation and harvesting of high-density CNT yarn materials according to an embodiment of the present disclosure.

Referring now to FIG. 8, a system similar to system 30, embodiments of which are described in U.S. Pat. No. 7,993,620 (filed Jul. 17, 2006) which is incorporated herein by reference for all purposes, may also be used for manufacturing nanostructured yarns. To manufacture yarns, housing 32, in system 30, can be replaced with an apparatus 80 to receive nanotubes 113 from the furnace 316 and spin them into yarn 15. The apparatus 80 may include a rotating spindle 14 that may collect nanotubes 113 as they exit tube 115. The rotating spindle 14 may include an intake end 141 into which a plurality of nanotubes 113 may enter and be spun into a yarn 15. The direction of spin, in an embodiment, may be substantially transverse to the direction of movement of the nanotubes through tube 115. Rotating spindle 14 may also include a pathway along which the yarn 15 may be guided toward an outlet end 143 of the spindle 14. The yarn 15 may then be collected on a spool 17.

It should be appreciated that in connection with the process of fabricating the yarn 15, in accordance with an embodiment of the present invention, similar to formation of sheet 321, a film or layer of ordered pyrolytic carbon is provided or formed on yarn 15. The ordered pyrolytic carbon film 3 (see FIGS. 3 and 4), in one embodiment, may be generated from carbon atoms that have not fully used in the formation of the individual carbon nanotubes. This layer or film 3 can help to enhance the structurally and mechanical integrity between yarn 15 and a low-density material that may be deposited on top of yarn 15 to subsequently form the nanostructured article. The presence of layer or film 3 can also enhance electrical and thermal conductivity throughout nanostructured article.

Figure 7:
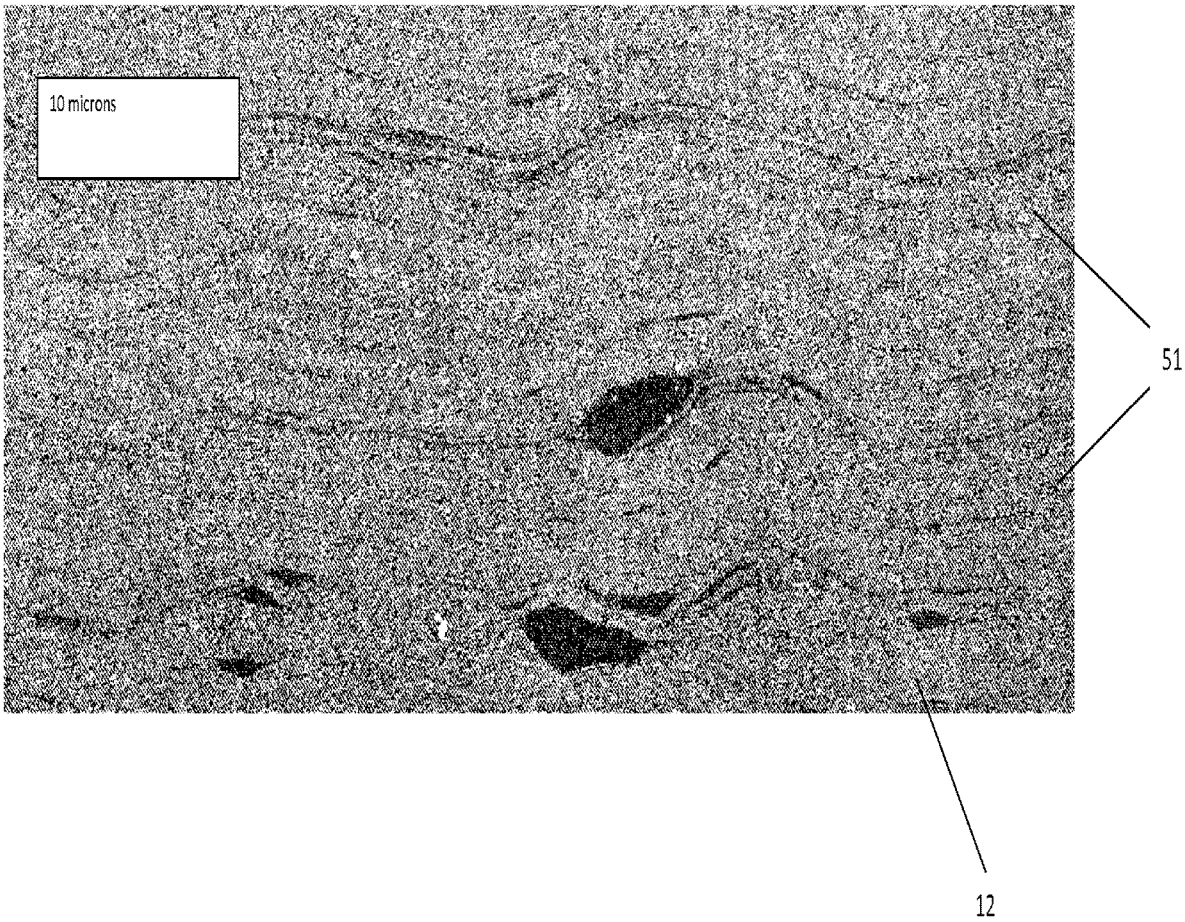
FIG. 7 depicts a cross-sectional view of a phyllo-dough arrangement of nanotubes within a high-density CNT sheet according to an embodiment of the present disclosure.

The CNT material produced by the systems shown, for example, in FIGS. 5 and 6 can be collected as a non-woven sheet on a moving belt 320, as shown in FIG. 5, or a drum, as shown in FIG. 6, or can be collected as a yarn on a spindle. Such production method can provide, in a CNT sheet or yarn which can be subsequently used in various applications. The carbon nanotubes 14, in an embodiment, can be deposited in multiple distinct layers 51 to form a multilayered structure or morphology in a single CNT sheet 12, as shown in FIG. 7. In some embodiments, the CNT sheet can have a low normal-to-plane or through-thickness thermal conductivity, which may result from inter-layer and/or inter-tube resistance.

In other embodiments, HD-CNT material 1 can be produced from nanotube powders produced by Chemical Vapor Deposition (CVD), Arc Discharge, Laser Ablation, High Pressure Carbon Monoxide CVD (HiPCO), or Fluidized Bed CVD processes. These nanotubes may subsequently be formed into various formats of HD-CNT material 1, including yarns, sheets, or tapes as further described herein.

In one such embodiment, these nanotubes can be made into a solution or slurry for subsequent formation into yarn, sheet, or tape formats of HD-CNT material 1. For example, the powder of nanotubes may be dispersed in a solvent using a surfactant, and subsequently filtered out to form a carbon nanotube sheet. As another example, yarns can be made from the nanotubes by dispersing the nanotubes in a super-acid, such as chlorosulfonic acid, and ejecting the dispersion through a nozzle at high pressure into a solvent bath containing water, acetone, or some other chemical suitable for neutralizing the super-acid. The resulting yarn may then be collected.

Forests of CNT's can be grown on a surface (e.g., an alumina support) coated with Supported Catalyst material (e.g., a thin layer of catalyst forming material such as iron) using CVD methods (SC-CVD) known in the art. These forest-grown CNT's can be peeled or scraped from the substrate and formed into sheet or tape embodiments of HD-CNT material 1. Additionally, yarn embodiments of HD-CNT material 1 can be spun directly from CNT forests using methods known in the art. CNT material produced by Floating Catalyst CVD (FC-CVD) can be collected on a moving belt or drum to produce a sheet or tape. CNT yarns can be spun directly from the materials emerging from a FC-CVD furnace using a suitable collection system. In any case CNT's produced in a variety of standard ways can be formed into yarns, sheets, and tapes for the core/support material.

Systems and Methods for Forming Low Density CNT Material 2 on High Density CNT Material I In various embodiments, LD-CNT material 2 may comprise a nanotube-containing coating applied to an outer surface of HD-CNT material 1. In various embodiments, LD-CNT material 2 may be formed from a nanotube-containing solution. The solution may comprise a dispersion of nanotubes in a solvent, such as water, ethanol, methanol, acetone, or mixtures of organic solvents. To the extent desired, a surfactant may be added to the solution to aid in dispersing the nanotubes, and the solution may further be subject to sonication and/or mechanical stirring. The solution, in an embodiment, may have a nanotube concentration ranging from about 0.5% to about 2%.

In one embodiment, LD-CNT material 2 may be formed by dip-coating HD-CNT material 1 in the nanotube-containing solution. The HD-CNT material 1 may be dipped any suitable number of times into the LD-CNT-based solution to form a coating of LD-CNT material 2 on HD-CNT material 1 of desired thickness. For example, HD-CNT material 1 may be dipped between about 1 to 5 times in the LD-CNT solution to form a coating of LD-CNT material 2 thereon of increasing respective thickness. In another embodiment, the solution may be doctor-bladed onto HD-CNT material 1. This approach, while viable for use with most embodiments of HD-CNT material 1, may be most appropriately suited for forming LD-CNT material 2 on a surface of sheet embodiments of HD-CNT material 1.

In some cases, the presence of solvent and/or surface oxides may compromise the bond between LD-CNT material 2 and HD-CNT material 1. That is, as the nanotube slurry coating dries on the surface of HD-CNT material 1, it may shrink and/or clump. This may lead to LD-CNT material 2 becoming brittle, and thus prone to cracking and/or breaking away from HD-CNT material 1. It is also possible that excess solvent may cause a void to form between LD-CNT material 2 and HD-CNT material 1 as it dries. Further, oxides may form as air reacts at defect sites.

Thus, to the extent desired, the material may be further treated to remove the solvent from the coating. For example, the material may be heat treated to bake off all or a portion of the solvent. In an embodiment, the material may be exposed to temperatures of about 100° C. to 200° C. for 1 to 2 hours. In some embodiments, the material may be placed in a vacuum whilst undergoing heat treatment to remove the solvent.

Figure 9:
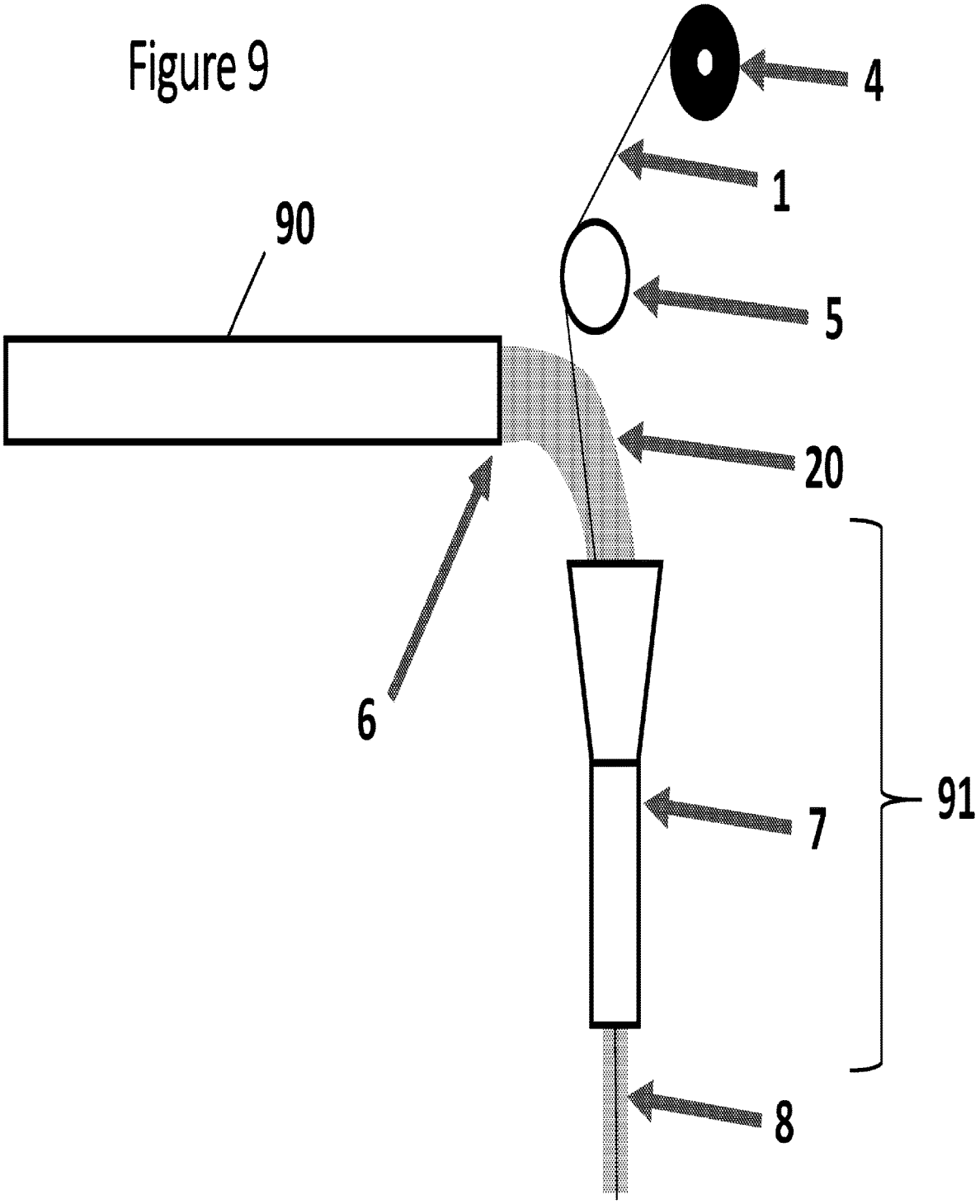
FIG. 9 depicts a system for formation of a low-density CNT material on a high-density CNT yarn material according to an embodiment of the present disclosure.
Figure 10:
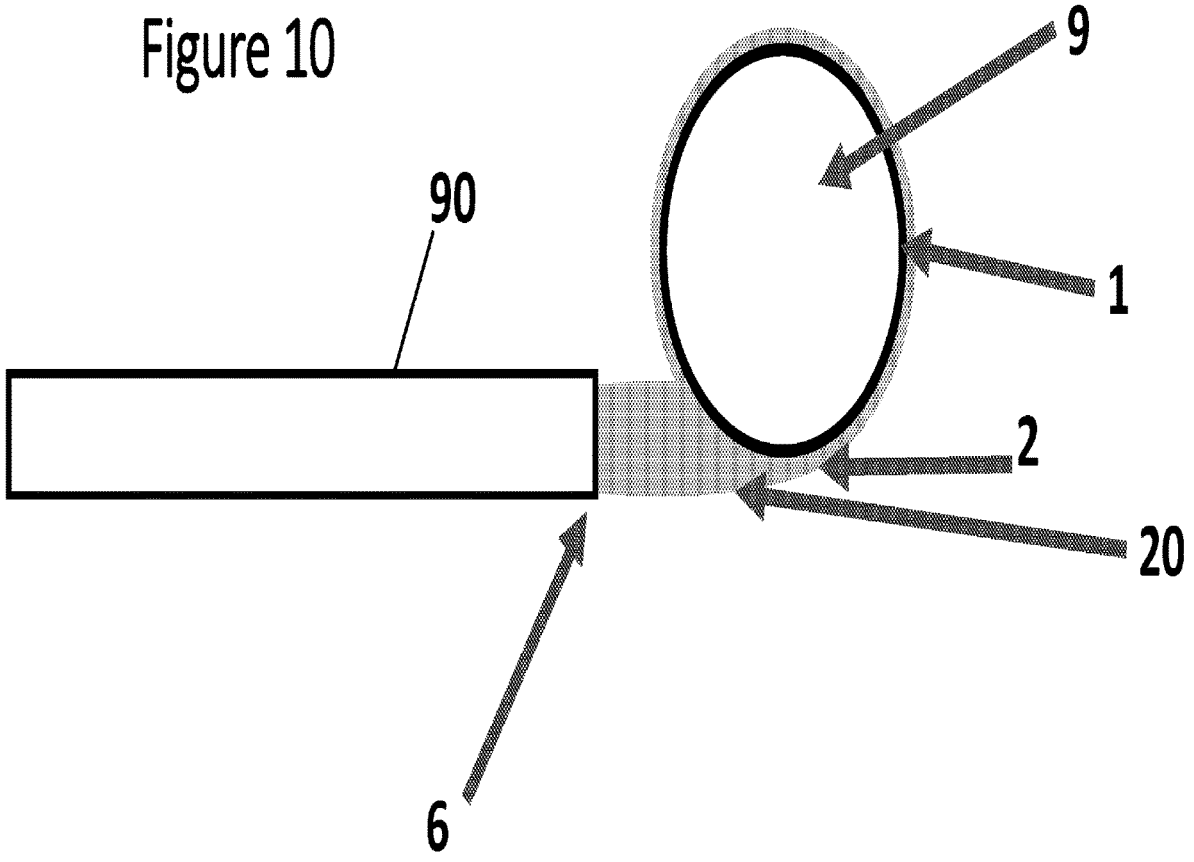
FIG. 10 depicts a system for formation of a low-density CNT material on a high-density CNT sheet material according to an embodiment of the present disclosure.

Referring now to FIGS. 9 and 10, in various other embodiments of the present invention, LD-CNT material 2 may instead be formed of an aggregate of nanotubes 20 deposited on HD-CNT material 1 in an FC-CVD reactor 91. In one such embodiment, HD-CNT material 1 may be placed in the FC-CVD reactor 91 near the exit 6 of the reaction furnace 90 such that nanotubes 20 formed and drifting therewithin come into direct contact with HD-CNT material 1 and the ordered pyrolytic carbon layer or film on the HD-CNT material 1 within the reactor 91 before interacting with another surface or chemical environment. In this way, the nanotubes 20 forming the LD-CNT material 2 can bond to HD-CNT material 1 in the presence of the pyrolytic carbon layer or film, for instance, in a hydrogen rich reducing environment, to improve the bonding between the materials. This can optimize the electrical, mechanical and thermal conductivity between the LD-CNT material 2 and the HD-CNT material 1.

Referring to FIG. 9, in the case of yarn or tape format, the HD-CNT material 1 can be introduced continuously near the exit 6 of the furnace 90. In one embodiment, HD-CNT material 1 is continuously introduced from a spool 4 and directed along a rotating anchor 5. By virtue of its positioning, anchor 5 may serve to collect the flowing nanotubes 20 such that they may be coupled with an outer surface of and pulled off by HD-CNT material 1. Tension applied to HD-CNT material 1 in this region may allow for smooth collection and stretching of the resulting material 100, which may result in improved properties for the material 100. The reaction gas flow can cause further nanotubes 20 to flow around and adhere to the continuous leader of HD-CNT material 1 forming the LD-CNT material 2. Thickness of the LD-CNT material 2 may be proportional to the furnace production rate and the draw rate of the HD-CNT material (i.e., residence time).

HD-CNT material 1 may be introduced at any suitable angle relative to the flow of nanotubes 20 exiting the furnace 90. In one embodiment, as shown in FIG. 9, HD-CNT material 1 may be introduced substantially perpendicular to the flow of nanotubes 20. In another embodiment, collection may occur at a relative angle of approximately 115 degrees. In yet another embodiment, nanotubes 20 may be collected on HD-CNT material 1 at relative angles of up to 180 degrees.

The resulting HD-CNT/LD-CNT material 100 can be collected as a loose tow or roving 8 and subsequently formed into a wire, yarn, tape, etc. In particular, the HD-CNT material 1 coated with LD-CNT material 2 may be directed through a rotating collection tube 7 in which it is spun into the tow or roving 8. In an embodiment, roving 8 may be collected on a spool (not shown).

The roving 8 can be further processed in a variety of ways to produce the desired wire, yarn or tape form factor. This processing may include, but is not limited to: cleaning, spinning, exfoliation, chemical infiltration, or any combination thereof. Processes to accomplish these tasks may include, but are not limited to: thermal, plasma, solvent dip, mechanical, chemical, electrochemical, or any combination thereof. For example, in one embodiment, roving 8 may be chemically loaded by subjecting it to CVD silicon coating or filtration coating with metal oxide nanoparticles. In another embodiment, roving 8 could be dipped into a solvent (e.g., acetone, ethanol, a mixture of ethanol and water, etc.) prior to being spun into a yarn or formed into a tape. In yet another embodiment, a wire may be formed by dipping roving 8 in a solvent, spinning it into a yarn, dipping the yarn into a solution containing a polymer, drawing the dipped yarn through a dye, and drying/curing the resulting product to form an insulated wire. One having ordinary skill in the art will recognize appropriate treatments for a given application given the form factor and chemistry suitable for said application. In any case a combination of techniques can used to obtain optimal properties in the hierarchically structured wire, yarn or tape. In some cases, it may be easier to treat the roving 8 in this low density state prior to processing the loose roving into wire, yarn or tape format.

Referring now to FIG. 10, in the case of sheet format, the HD-CNT material 1 can be introduced into the sheet collection system on or near the collection belt or drum 9. The reaction gas flow coming out of an exit end 6 of a floating catalyst furnace 90 can cause nanotubes 20 to flow onto the surface of the HD-CNT material 1 and collect thereon to form LD-CNT material 2. The resulting material can be harvested as a hierarchically structured sheet. The resulting sheet can be further processed in a variety of ways. This processing may include, but is not limited to: cleaning, exfoliation, chemical infiltration, or any combination thereof. Processes to accomplish these tasks may include, but are not limited to: thermal, plasma, solvent dip, mechanical, chemical, electrochemical, or any combination thereof. In any case a combination of techniques can used to obtain optimal properties in the desired form factor.

Drum/belt 9 may be positioned and oriented in any manner suitable to collect nanotubes 20 flowing from the exit end 6 of the furnace 90. In an embodiment, drum/belt 9 may be positioned higher than exit 6, as in some cases, nanotubes 20 may tend to float upwards upon exiting the furnace 90. In this manner, drum 9 is positioned to catch those upward floating nanotubes 20.

Drum/belt 9 may be configured to rotate in any suitable direction. In the embodiment of FIG. 10, it may turn counter-clockwise.

Sheets of various lengths may be collected. In the embodiment of FIG. 10, sheets may be formed with a length not exceeding the diameter of drum 9. It should be noted that one having ordinary skill in the art will appreciate that the collection system could be modified in any number of ways to make longer sheets. For example, continuous formation of longer sheets could be achieved in a manner somewhat similar to that described in the context of a yarn above. Specifically, material 1 could be continuously dispensed, perhaps from a dispensing drum, and introduced into the flow of nanotubes exiting the furnace for formation of material 2 thereon. The resulting material could then be continuously collected on a separate collection drum. Of course, other embodiments of continuous formation are envisioned.

In an embodiment, hierarchically structured material may comprise a core/layer of HD-CNT material 1 having a diameter ranging from about 0.1 mm to about 1 mm, a density ranging from about 0.75 g/cc to about 1.5 g/cc, a macro-porosity near zero, and electrical conductivity ranging from about 1 S/m to about 10E6 S/m or greater, and a tensile strength of >1 N/tex. In another embodiment, hierarchically structured material may comprise a sheath/layer of LD-CNT material 2 having a thickness ranging from about 1 micron to about 100 microns, a density ranging from about 0.1 g/cc to about 0.5 g/cc, significant macro porosity (for example, from about 0.1 micron pores to about IO micron pores), and electrical conductivity ranging from about 2 S/m to about 5E5 S/m. In yet another embodiment, the hierarchically structured material may have a tensile strength of approximately 0.5 N/tex. These embodiments are merely illustrative—one of ordinary skill in the art will recognize any suitable relative dimensions and properties of the hierarchically structured material of the present disclosure.

Example 1: Electrochemical Application

In this embodiment a CNT yarn, tape or sheet is produced by the FC-CVD method. It is then post-synthesis processed by dipping and stretching, using a protonating agent (i.e. super-acid), to densify and improve the tensile strength and electrical conductivity of the core/support CNT material. The resulting high density, high strength, and electrically conductive material is re-introduced into an FC-CVD furnace either as a continuous leader in the case of a yarn or tape, or as a cover on the collection drum or belt of a sheet system. A layer of low density CNT material 2 is deposited on and/or around the HD-CNT core/support material 1. The resulting hierarchically structured material (HSM) can be further processed into the desired form factor.

The HSM thus produced can be used for vanous electrochemical applications. One family of applications would be for the cathodes of lithium ion batteries (LiB's). The cathode chemistry desired for the battery could be infiltrated into the porous layer of the hierarchical structure. For example, lithium sulfide could be dissolved into ethanol, and deposited into the porous structure of the HSM as it is drawn through the solution. The loading level could be controlled by adjusting the concentration of lithium sulfide, the dwell time of the material in the solution, and the number of times the material is dipped into the solution. The loaded material can be dried, and either woven, braided or plied and cut to shape in the case of yarn, or simply cut to shape in the case of tape or sheet into the desired form factor for the battery. The result would be a flexible, strong cathode that does not require bonding to a metallic current collector. This product would be integrated into products that may include, but are not limited to: clothing, tarps, coaxial cables, walls, floors, or satellite structural panels.

Other LiB cathode chemistry systems could be introduced into the HSM instead of lithium sulfide, either through solution dipping, or by filtration (using the HSM as a filter medium for a suspension of nanoparticles). Such chemistry may include, but is not limited to: lithium nickel manganese cobalt oxides, lithium manganese oxide, and lithium iron phosphate. Loading of the chemistry into the HSM could be done at the roving stage, before or during spinning in the case of the yarn format. The resulting cathode would have the capacity characteristic of the chemistry used.

Another embodiment would be the formation of the anode for a lithium ion battery. In this case the desired chemistry may include, but is not limited to: lithium titanate, tin/cobalt, or silicon. Nanoparticles of the desired chemistry could be introduced by filtration, or the HSM could be coated with metallic species using Atomic Layer Deposition (ALD), Chemical Vapor Infiltration (CVI), or CVD. In one embodiment the HSM could be silicon coated using Low Pressure CVD, or Plasma Enhanced CVD at the roving stage to ensure maximal infiltration of the silicon coating. The material could be introduced into a chamber, and coated with a thin layer of silicon (<50 nm) using the thermal decomposition of silane. The HSM roving with a coating of silicon could then be spun into a yarn. The loaded yarn can be either woven, braided or plied into the desired form factor for the battery. Similar processing could use tape or sheet formats. The result would be a flexible, strong anode that does not require bonding to a metallic current collector. Alternatively, other chemical systems could be introduced instead of silicon, either through solution dipping, or by filtration. The resulting anode would have the capacity characteristic of the chemistry used.

Another embodiment would involve plying HD-CNT yarn material 1 with a metallic wire to form the core structure. An example would be to ply 3-100 strands of copper wire with 3-100 strands of chemically stretched and densified CNT yarn. The resulting ply could then be coated with LD-CNT material 2 in a yarn furnace. The resulting HSM could be infiltrated with desired anode/cathode chemistry, and woven, braided or plied into a desired format for battery applications.

Another embodiment would be the formation of capacitors. One or both of the electrodes in a capacitor could be HSM without any additional chemical species infiltrated. One electrode may have nanoparticles infiltrated into the HSM. Such nanoparticles may include, but are not limited to: ruthenium oxide, iridium oxide, manganese oxide, titanium sulfide or combinations thereof. Additionally, or alternatively, the HSM could be infiltrated with a conducting polymer. Such polymers may include, but are not limited to: polyaniline, polythiophene, polypyrrole, polyacetylene, polyacene, or any combination thereof. In any case the loaded HSM electrodes could be packaged to form a capacitor without separate metallic current collectors.

Example 2: Polymer Composite Applications

CNT material in sheet, tape and yarn formats have been used as reinforcement in polymer composites. Often the failure mechanism in tensile testing is pull-out of the CNTs from the polymer due to poor CNT/polymer bonding. Improving the polymer/CNT interaction may be expected to improve the properties of the composite. Using HSM and infiltrating the porous layer with polymer could be expected to improve the tensile strength and other mechanical/thermal properties of the composite. The use of conducting polymers would be expected to improve the electrical properties of the composite. The mechanical/thermal/electrical properties could be adjusted by varying the polymer used, as well as the physical parameters of the hierarchical structure, such as the diameter of the core, and the thickness and density of the sheath material.

One embodiment would be to make cables using this hierarchical structure. The conductive core, comprising chemically densified CNT material which may be plied with copper or aluminum, could be surrounded by low density sheath CNT material that is infiltrated with an insulating polymer. The result is a light-weight, insulated wire of high tensile strength suitable for applications such as motor windings, power or data cables. Such cables could be very small in diameter (i.e.
0.15 mm-1 mm) and very light (i.e. ⅙ the density of copper). Infiltrating the polymer into the low density sheath, rather than simply coating the core, could improve the
bond between the polymer and the conductor, mechanically reinforce the polymer, and increase the strength of the cable.

Another embodiment would be to make sensors using HSM. The hierarchical material could be infiltrated with species that include, but are not limited to: solvents, polymers, metallic nanoparticles, DNA, or combinations thereof. The infiltrated chemical species would be chosen to selectively bind to a target molecule, thus changing the AC and/or DC resistance of the material in the presence of the target. Chemicals that could be detected with high sensitivity include, but are not limited to: explosives, chemical weapons, common solvents and chemicals, air contaminants, atmospheric carbon dioxide levels, ground water contaminants, and combinations thereof. Sensors could also be designed to detect strain in a material, or electromagnetic radiation. These various sensors could be integrated into clothing, materials, or structural components as needed.

Example 3: Chemical Catalysis Applications

Doped CNT material has been shown to have chemical catalysis properties. CNT's doped with boron and/or nitrogen have been shown to catalyze the oxygen reduction reaction better than platinum. One embodiment would be to create a core/sheath hierarchical structure using chemically densified yarn ply as the core, and dope the low density CNT material for the sheath with during the CNT growth so as to substitute some carbon atoms with other atoms. Atoms to be interstitially substituted could include, but are not limited to: boron, nitrogen, phosphorus, sulfur or some combination thereof.

Another embodiment would involve doping the LD-CNT material 2 in an HSM with chemical species that coat the CNT's after they are formed. Such non-interstitial doping could include, but not be limited to: solvents, and/or organic molecules containing boron, nitrogen, phosphorus, sulfur or some combination thereof.

Applications for these catalytic HSM's could include, but not be limited to devices for: photo-catalytically splitting water to create hydrogen and oxygen in the presence of sunlight, a membrane for a fuel cell, an electrode in a sodium or lithium/air battery, a photovoltaic yarn.

Example 4: Lithium Ion Battery Anode

Several strands (i.e. 3-30) of Chemically Stretched Yarn (CSY) from Nanocomp Technologies are plied with a few strands (i.e. 3) of 40 AWG copper wire, to form the core material in HSM. This ply is passed through the furnace collection region (FIG. 10) as a continuous leader, and low density CNT material is deposited on and around the core leader material. The resulting HSM is collected on a spool. This spool of HSM is loaded into a CVD chamber, where silicon is deposited by low pressure CVD to the thickness of no more than 50 nm. This Si Coated HSM is then loaded with lithium by electrochemical means. The resulting material is then spun into a yarn, braided into a tape of the required width and thickness. The product is then installed as the anode in a lithium ion battery by combining with a cathode, separator, electrolyte and case using incumbent technology.

Example 5: Lithium Ion Battery Cathode

Several strands (i.e. 3-30) of Chemically Stretched Yarn (CSY) from Nanocomp Technologies are plied to form the core material in HSM. This ply is passed through the furnace collection region (FIG. 10) as a continuous leader, and low density CNT material is deposited on and around the core leader material. The resulting HSM is collected on a spool. This HSM is dip-coated through a solution of lithium sulfide dissolved in ethanol. The resulting material is then spun into a yarn, braided into a tape of the required width and thickness. The product is then installed as the cathode in a lithium ion battery by combining with an anode, separator, electrolyte and case using incumbent technology.

Example 6: Super-Capacitor

A sheet of Chemically Stretched Sheet material (CSS) from Nanocomp Technologies is applied to the collection drum of a CNT sheet furnace to form the support in HSM. CNT material is then deposited on the support affixed to the collection drum to the required thickness (i.e. 10-15 grams per square meter). The HSM is harvested from the furnace collection system, and cut to the desired dimensions to make one electrode in the capacitor. Another HSM sheet is prepared as described above, and is loaded with the desired chemistry. One example of this chemistry would be manganese oxide nanoparticles. Other examples of incorporated chemistry would be ruthenium oxide, iron oxide, and titanium sulfide, or combinations thereof. The desired chemistry could be loaded into the HSM by creating a suspension of the nanoparticles in a solvent, and filtering the suspension through the HSM until the required loading is obtained. This MO-HSM can then be cut into the desired form factor for the desired capacitor. A capacitor can then be made by combining the HSM, the MO-HSM, a separator, electrolyte and case to manufacture a capacitor.

Example 8: Sensor

One or several strands of Chemically Stretched Yarn (CSY) from Nanocomp Technologies form the core material in HSM. This core material is passed through the furnace collection region (FIG. 10) as a continuous leader, and low density CNT material is deposited on and around the core leader material. The resulting HSM is collected on a spool. The material could then be dip-coated with a sensitizer such as a polymer, a metal oxide or a specifically sequenced DNA molecule. The loaded HSM is then spun into a yarn, and incorporated into a devise to measure its resistance and/or AC impedance. The electrical signal through the loaded yarn would very in response to the target species. For example, an HSM yarn loaded with a specific DNA molecule could detect ppb levels of molecules that indicate the presence of TNT or Sarin gas.

Example 9: Fuel Cell Membrane

A sheet of Chemically Stretched Sheet material (CSS) from Nanocomp Technologies is applied to the collection drum of a CNT sheet furnace to form the support in HSM. CNT material is then produced using a fuel formulation that dopes the CNT material positively (i.e. boron). This material is deposited on the support affixed to the collection drum to the required thickness (i.e. 10-15 grams per square meter). The p-HSM is harvested from the furnace collection system, and cut to the desired dimensions to make one side of the fuel cell membrane. Alternatively the LD-CNT material 2 can be p-doped by solution treatment after harvesting. Another HSM sheet is prepared as described above, except that the fuel contains species that will dope the CNT material negatively (i.e. nitrogen or phosphorus). Alternatively the LD-CNT material 2 can be n-doped by solution treatment after harvesting. A separator can be applied to the support of one of the sheets, one example would be a coating of titanium dioxide. The two sheets with separator between may be combined to for a single membrane. This device may for the proton exchange membrane in a fuel cell.

Throughout the specification and claims, terms may have nuanced
meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

While various embodiments have been described for purposes of this disclosure, such embodiments should not be deemed to limit the teaching of this disclosure to those embodiments. Various changes and modifications may be made to the elements and operations described above to obtain a result that remains within the scope of the systems and processes described in this disclosure.

What is claimed is:

1. A method for forming a nanostructured article, the method comprising: contacting a first material with a second material as tension is being applied to the first material, wherein (i) the first material comprises a plurality of intermingled nanotubes in the form of a sheet, yarn, wire or tape which has been subjected to a post-synthesis process comprising one or more of cleaning, stretching, exfoliation, densification and cross-linking, and (ii) the second material comprises a plurality of nanotubes in the form of a layer situated on a surface of the first material, wherein the second material has a nanotube density ranging from about 0.1 g/cc to about 0.5 g/cc, and wherein the nanotube density of the second material is lower than the nanotube density of the first material, and wherein the step of contacting the first material with the second material comprises at least one of (a) placing the first material in or near a floating catalyst chemical vapor deposition (FC-CVD) reactor such that the plurality of intermingled nanotubes of the second material contacts the first material, and (b) coating the first material with a dispersion containing a plurality of nanotubes and a solvent such that at least a portion of the plurality of nanotubes are coated on the first material to form the second material.

2. The method of claim 1, wherein the plurality of intermingled nanotubes of the first material are synthesized, via chemical vapor deposition, on floating catalyst particles within a reactor.

3. The method of claim 1, wherein the first material has a nanotube density ranging from about 0.75 g/cc to about 1.5 g/cc.

4. The method of claim 1, wherein the first material has an electrical conductivity ranging from about 1 S/m to about 10E6 S/m or greater.

5. The method of claim 1, wherein the first material has a tensile strength of greater than about 1 N/tex.

6. The method of claim 1, wherein the second material has pores of between about 0.1 microns and about 10 microns.

7. The method of claim 1, wherein the second material has an electrical conductivity ranging from about 2 S/m to about 5E5 S/m.

8. The method of claim 1, wherein the plurality of nanotubes deposited on the first material to form the second material are bonded with the surface of the first material in a hydrogen rich environment.

9. The method of claim 1, wherein the first material and the second material are in the form of a sheet or yarn.

* * * * *